United States Patent [19]

Chu

[11] 4,439,773

[45] Mar. 27, 1984

[54] COMPACT SCANNING BEAM ANTENNA FEED ARRANGEMENT

[75] Inventor: Ta-Shing Chu, Lincroft, N.J.

[73] Assignee: Bell Telephone Laboratories, Incorporated, Murray Hill, N.J.

[21] Appl. No.: 338,352

[22] Filed: Jan. 11, 1982

[51] Int. Cl.[3] ..... H01Q 19/12

[52] U.S. Cl. ..... 343/778; 343/779; 343/781 P

[58] Field of Search ..... 343/781 P, 781 CA, 835–837, 343/778, 779

[56] References Cited

U.S. PATENT DOCUMENTS

| | | | |
|---|---|---|---|
| 2,945,228 | 7/1960 | Ramsay et al. | 343/755 |
| 3,267,472 | 8/1966 | Fink | 343/100 |
| 3,881,178 | 4/1975 | Hannan | 343/779 |
| 4,062,018 | 12/1977 | Yokoi et al. | 343/781 CA |
| 4,223,316 | 9/1980 | Drabowitch | 343/781 P |
| 4,250,508 | 2/1981 | Dragone | 343/779 |
| 4,259,674 | 3/1981 | Dragone et al. | 343/909 |
| 4,298,877 | 11/1981 | Sletten | 343/781 |

*Primary Examiner*—Eli Lieberman
*Assistant Examiner*—Michael C. Wimer
*Attorney, Agent, or Firm*—Erwin W. Pfeifle

[57] ABSTRACT

The present invention relates to a feed arrangement for use with compact scanning beam antennas which comprises a linear phased array of small feed elements (10) which form an approximate line source that radiates a wedge-shaped cylindrical beam toward a subreflector (12) which is shaped to focus the wedge-shaped cylindrical beam to a point source which then produces a spherical wavefront. The spherical wavefront can then be focused by a main reflector (14) into linear scanning beams if desired. Multiple linear phased arrays of small feed elements can be disposed parallel to each other to form a multibeam feed arrangement for producing multiple fixed or scanning spot beams.

4 Claims, 2 Drawing Figures

COMPACT SCANNING BEAM ANTENNA FEED ARRANGEMENT

BACKGROUND OF THE INVENTION

1. Field of the Invention

The present invention relates to a compact scanning beam antenna and, more particularly, to a compact scanning beam antenna feed arrangement which comprises a linear phased array of small feed elements forming an approximate line source and a subreflector which is shaped to focus an approximate wedge-shaped cylindrical beam generated by the line-source linear phased array to a point source to produce a sherical wavefront which can be reflected by a main parabolic reflector to convert the spherical wavefront from the point source into a planar wavefront aimed toward a predetermined direction at the aperture of the antenna.

2. Description of the Prior Art

Recently suggested designs for future generation satellite communication systems have proposed the use of one or more scanning spot beams at a satellite switching repeater for separately receiving and transmitting signals associated with a plurality of remote, spaced-apart, ground stations. One of the most recent designs, also forming the subject matter of a copending patent application Ser. No. 33,735, filed for A. Acampora et al on Apr. 26, 1979, now U.S. Pat. No. 4,315,262, and assigned to the same assignee, incorporates a satellite switching repeater which uses a plurality of linear scanning spot beams to concurrently scan along separate parallel strips of the overall ground service region of the satellite communication system in accordance with a predetermined communication sequence. In the arrangement of the copending application, each set of a linear array of feedhorns is located in the focal plane of a cylindrical parabolic reflector oriented parallel to the linear array feeds. Each row of feedhorns acts essentially as a line source radiating a wavefront which is transformed by the reflector into a spot beam in the far field of the cylindrical reflector.

Another linear scanning antenna is disclosed in U.S. Pat. No. 4,250,508 issued to C. Dragone on Feb. 10, 1981 which relates to a feed arrangement comprising a linear array of feed elements disposed within a rectangular waveguide section including an offset curved focusing reflecting surface which bidirectionally converts an essentially planar wavefront from the array into a converging wavefront that is focused to a focal point on the focal plane of the feed arrangement. When the array is scanned in one angular coordinate the resulting point sources at the focal plane move along a straight line and are always directed at a predetermined remote point beyond the focal plane regardless of the direction of scan along the one angular coordinate.

Still another linear scanning type antenna arrangement is disclosed in U.S. Pat. No. 4,259,674 issued to C. Dragone et al on Mar. 31, 1981 which relates to an exemplary Gregorian phased array antenna arrangement. There, a main parabolic reflector and a parabolic subreflector are arranged confocally so that a magnified image of a linear feed array disposed along an array plane is formed over the aperture of the main reflector. Also included in the antenna arrangement is a filtering means to reduce grating lobes, and more particularly, for placing a filter at one of the antenna arrangement's real focal points in such a manner as to block the grating lobes due to the array structure while allowing the central ray to pass through the filter. The linear phased array of such arrangement is shown as comprising, for example, a plurality of long feedhorns for also minimizing the phase error in the plane wave feed arrangement.

Since both weight and volume are severely restricted in a satellite, the problem remaining in the prior art is to provide a phased array antenna arrangement and feed which is more compact than prior art arrangements and still provides comparable performance characteristics.

SUMMARY OF THE INVENTION

The problem remaining in the prior art has been solved in accordance with the present invention which relates to a compact scanning beam antenna and, more particularly, to a compact scanning beam antenna feed arrangement which comprises a linear phased array of small feed elements forming an approximate line source and a subreflector which is shaped to focus an approximate wedge-shaped cylindrical beam generated by the line-source linear phased array to a point source to produce a spherical wavefront which can be reflected by a main parabolic reflector to convert the spherical wavefront from the point source into a planar wavefront aimed toward a predetermined direction at the aperture of the antenna.

It is an aspect of the present invention to provide a compact scanning beam antenna feed arrangement which permits a considerable reduction in feedhorn size from known antenna arrangements.

Other and further aspects of the present invention will become apparaent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
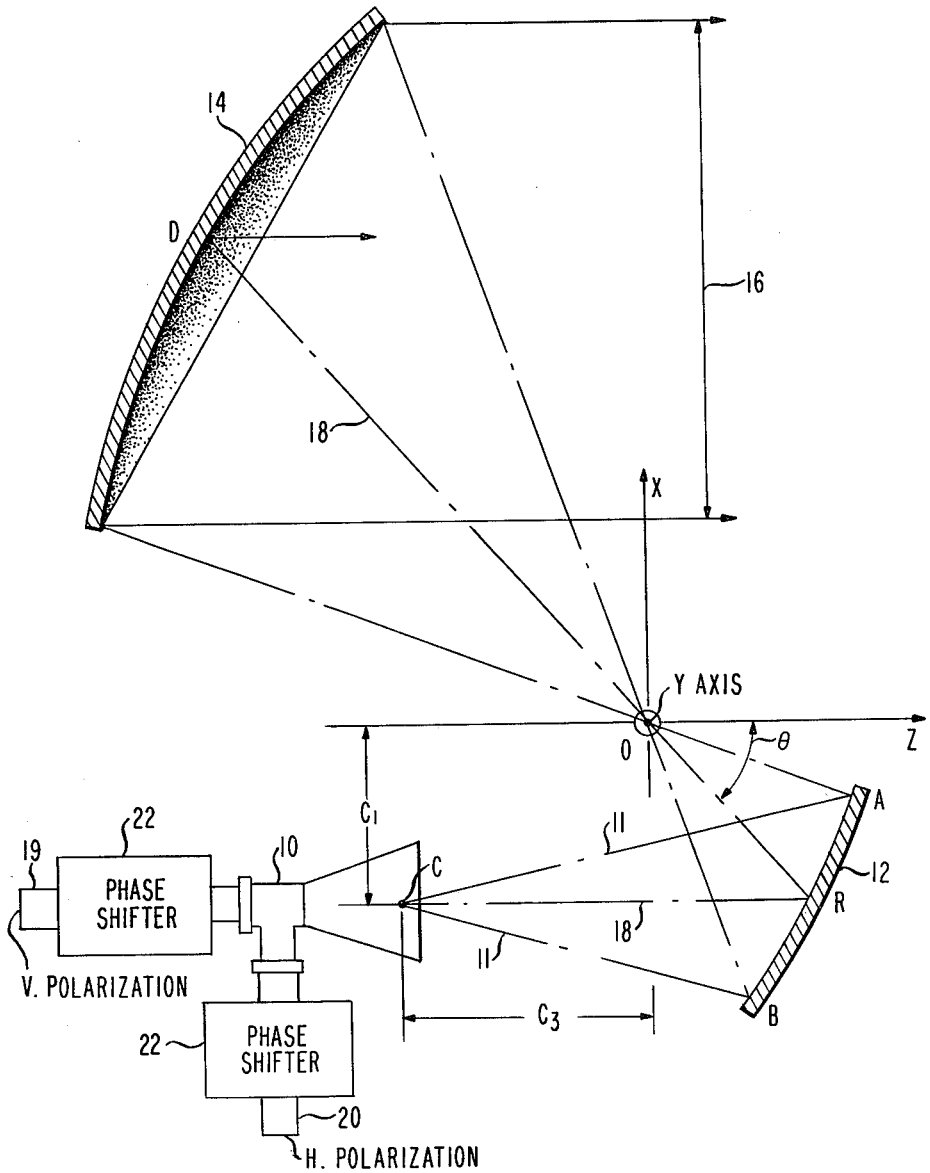
FIG. 1 illustrates a cross-sectional side view of an antenna arrangement in accordance with the present invention which includes a shaped subreflector fed by a linear array of small horns forming an approximate line source.
Figure 2:
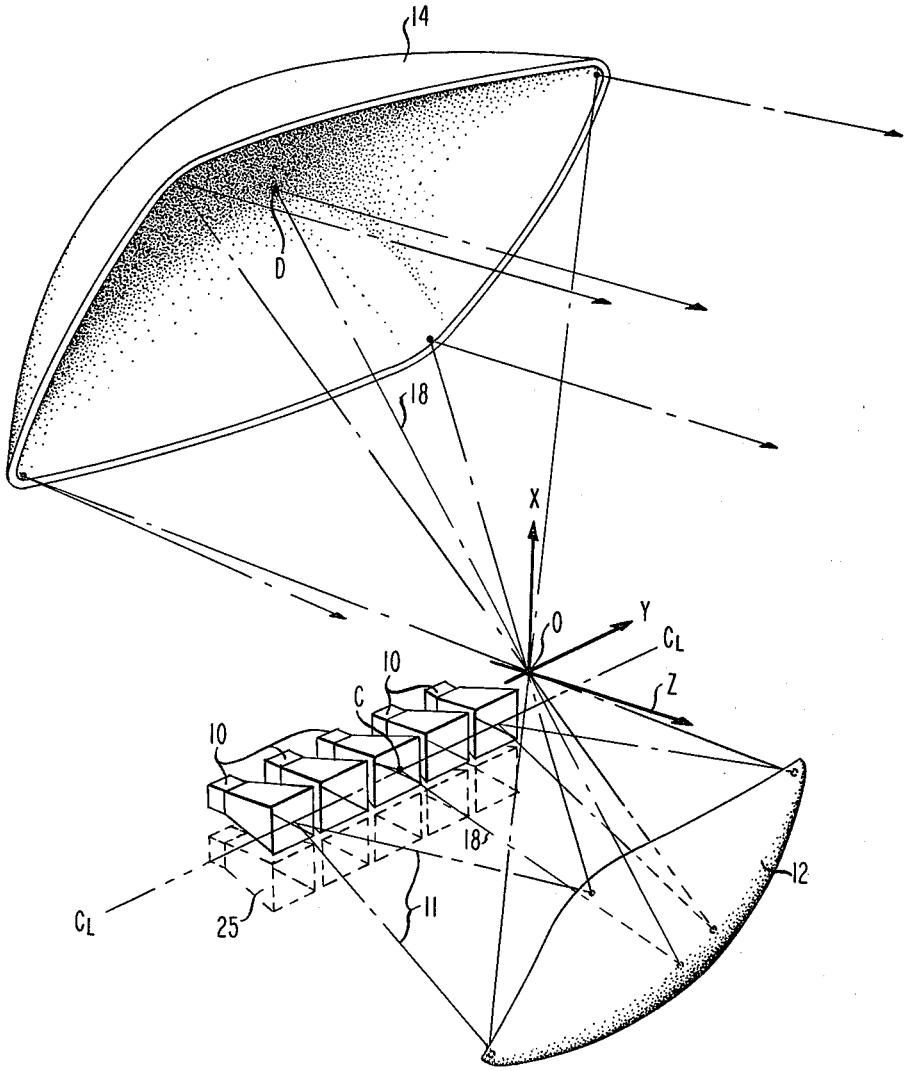
FIG. 2 illustrates a view in perspective of the antenna arrangement of FIG. 1.

FIGS. 1 and 2 illustrate an exemplary compact antenna arrangement in accordance with the present invention comprising a linear array of small feedhorns 10 forming an approximate line source which is capable of radiating a cylindrical wedge-shaped beam 11 in a predetermined direction. Beam 11 can be made scannable as is well known in the art by the inclusion of appropriate phase shift means 22 at the input to each feedhorn. A predetermined shaped subreflector 12 functions to focus the cylindrical wedge-shaped beam from the line source array 10 to a focal point 0 of subreflector 12 to form, in the vicinity of said focal point, a point source from which the focused beam will radiate as a spherical beam. A parabolic main reflector 14 can be disposed confocally with subreflector 12 to cause a spherical beam emanating from the point source to be reflected as a planar wavefront at aperture 16 of main reflector 14 toward a remote receiver.

As shown in FIG. 1, each of the feedhorns 10 of the linear array can also be made to concurrently launch a first polarized signal, e.g., vertical polarization, and a second polarized signal, e.g., horizontal polarization, by the introduction of such polarized signals at separate input ports 19 and 20, respectively. A central ray 18 of the cylindrical wedge-shaped beam 11 radiating from feedhorns 10 is shown as impinging point R on subreflector 12 and passing through focal point 0 and impinging at point D on main reflector 14 before being launched toward the distant receiver.

In accordance with the present invention, the present antenna transforms a cylindrical wedge-shaped wave from a line source produced by the linear array of small feedhorns 10 into a spherical wave of a point source, in the vincinity of the focal point 0, by a predetermined shaped subreflector 12. The shape of the reflecting surface of subreflector 12 can be easily determined by imposing a constant path length for all specularly reflected geometrical-optic rays from the line source to the focal point 0.

If, for example, the focal point is located at the origin of a cartesian coordinate system in FIG. 1, and the line source, disposed parallel to the y-axis, is located at $X=-C_1$, $Z=-C_3$, then the reflector for transformation between the point source and the line source is given by the following equation:

$$\sqrt{X^2+Y^2+Z^2}+\sqrt{(X+C_1)^2+(Z+C_3)^2}=C_1\cot(\theta/2)+C_3 \quad (1)$$

where $\theta$ is the offset angle between the Z-axis and the reflected central ray RO in XZ-plane from the shaped reflector to the point source. The corresponding incident ray CR from the line source to the shaped reflector 12 also lies in the XZ plane and is parallel to the Z-axis. In FIG. 1, CR bisects the angle CAB substended by the reflector at the line source.

The properties of the present antenna in terms of a comparison with the current antennas using a near field Gregorian configuration will now be described. It is first noted the Equation (1) can be solved for Z. Then numerical machining of the shaped subreflector surface should not be more difficult than that of a paraboloidal subreflector. In FIG. 1, the F/D ratio can be defined as the ratio between $\overline{OR}$ and the length of the line source, i.e., the length of a feedhorn array. If this ratio is the same (about unity) as that of a near field Gregorian antenna, any phase aberration of the scanning beam will also be expected to remain the same.

The shaped reflector 12 will first focus the feed energy into a point source in the vicinity of the focal point 0 before illuminating the main paraboloidal reflector 14. Therefore, a technique of sidelobe reduction by spatial filtering as shown in U.S. Pat. No. 4,259,674, which is essentially an aperture stop in the focal plane, can be applied in the same way as that for near-field Gregorian configuration.

The basic imaging advantage of the near-field Gregorian configuration will be also realized in the present antenna if the location of the line source formed by feedhorn 10 in FIGS. 1 and 2 satisfies the thin lens formula.

$$(1CR)+(1DR)=(1OR) \quad (2)$$

In other words, the linear phased array aperture is preferably disposed at the conjugate plane of the aperture plane of the main reflector 14.

To provide illumination over an angular sector ARB in FIG. 1 instead of a plane wave feed, the vertical aperture dimension of the feedhorn 10 will be, for example, about $2\lambda$ and the horn length can be reduced to a quarter of that needed in the antenna of U.S. Pat. No. 4,259,674. Since aperture blocking is also absent in the present antenna, the shaped subreflector 12 can be oversized to minimize spill-over loss.

In addition to linear (one dimensional) scanning of one beam, the present antenna arrangement also has the potential of being extended to multiple parallel linear scanning spot beams by adding additional line sources (i.e., linear phased array of small horns 10) above or below point C as shown, for example, in FIG. 2 by the addition of feedhorns 25.

What is claimed is:

1. An antenna feed arrangement comprising:

a plurality of feed elements (10) disposed to form a linear phased array and capable of launching or receiving a wavefront at an aperture of the linear phased array where each of the feed elements comprises a small feedhorn which in combination with the other feed elements is capable of forming an approximate line source for generating a cylindrical wedge-shaped beam at the aperture of the linear phased array;

phase shifting means (22) connected to the plurality of feed elements for selectively producing a predetermined linear phase taper along the aperture of the linear phased array; and a reflector (12) comprising a predetermined shape for bidirectionally reflecting the cylindrical wedge-shaped beam from the linear phased array into a converging beam toward a focal plane of the antenna feed arrangement to form an approximate point source at said focal plane from which a spherical wavefront is generated.

2. An antenna feed arrangement according to claim 1 wherein the central location of an approximate point source forming a spherical wavefront is disposed at an origin of a cartesian coordinate system comprising an X, Y and Z axis, the linear phased array being disposed to orient the approximate line source parallel to the Y axis at a location where $X=-C_1$ and $Z=-C_3$, and the reflector for transformation between the approximate point source and the approximate line source is defined by $$\sqrt{X^2+Y^2+Z^2}+\sqrt{(X+C_1)^2+(Z+C_3)^2}=C_1\cot(\theta/2)+C_3$$

where $\theta$ is the offset angle between the Z axis and a central ray (18) of the wavefront in the XZ-plane from the reflector to the point source.

3. An antenna feed arrangement according to claim 1 or 2 wherein the aperture dimension of each feedhorn in one direction approximates two wavelengths of a frequency band signal capable of being transmitted or received by said plurality of feed elements.

4. An antenna feed arrangement according to claim 1 or 2 wherein the antenna feed arrangement comprises a second plurality of feed elements (25) disposed to form a second linear phased array parallel to said first linear phased array and capable of launching or receiving a wavefront at an aperture of the second linear phased array where each of the feed elements of the second linear phased array comprises a small feedhorn which in combination with the other feed elements of the second linear phased array is capable of forming an approximate line source for generating a cylindrical wedge-shaped wavefront at the aperture of the second linear phased array which is focused to an approximate second point source by said reflector.

* * * * *